US006439546B1

(12) United States Patent
Galka

(10) Patent No.: US 6,439,546 B1
(45) Date of Patent: Aug. 27, 2002

(54) CARBURETOR WITH FUEL VAPOR CONTROL

(75) Inventor: William E. Galka, Caro, MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/650,185

(22) Filed: Aug. 29, 2000

(51) Int. Cl.[7] ..... F02M 37/22

(52) U.S. Cl. ..... 261/4; 261/5; 261/35; 261/69.1; 261/DIG. 68; 261/40

(58) Field of Search ..... 261/4, 5, 35, 69.1, 261/69.2, DIG. 55, DIG. 68, 40, 41.1

(56) References Cited

U.S. PATENT DOCUMENTS 3,085,791 A * 4/1963 Phillips ..... 261/35
3,272,485 A * 9/1966 Newman ..... 261/DIG. 68
3,275,306 A * 9/1966 Phillips ..... 261/35
3,454,265 A * 7/1969 Phillips ..... 261/DIG. 68
4,104,994 A * 8/1978 Phillips ..... 261/35
4,770,822 A * 9/1988 Sejimo ..... 261/DIG. 68
5,775,300 A * 7/1998 Sugii ..... 261/35 X
5,891,369 A * 4/1999 Tuggle et al. ..... 261/35

FOREIGN PATENT DOCUMENTS

JP 60-88857 * 5/1985 ..... 261/35
JP 10131807 A 5/1998

* cited by examiner

*Primary Examiner*—Richard L. Chiesa
(74) *Attorney, Agent, or Firm*—Reising, Ethington, Barnes, Kisselle, Learman & McCulloch, P.C.

(57) ABSTRACT

A carburetor having a plurality of restricted fluid flow paths upstream of a fuel and air mixing passage to inhibit the passage of large fuel vapor bubbles through the fuel paths and to the fuel and air mixing passage. Desirably, the restricted flow paths constrain large volume vapor bubbles and clusters of bubbles from passing therethrough undistributed in the fuel to prevent an inconsistent or overly lean fuel and air mixture from being delivered to the engine. At least two restrictive flow paths diffuse, separate, and/or break up the large vapor bubbles and clusters into a plurality of smaller vapor bubbles which are more uniformly distributed within the liquid fuel flowing through the carburetor to provide a more consistent flow of fuel to the engine.

20 Claims, 2 Drawing Sheets

CARBURETOR WITH FUEL VAPOR CONTROL

FIELD OF THE INVENTION

This invention relates generally to carburetors and more particularly to diaphragm type carburetors.

BACKGROUND OF THE INVENTION

Carburetors are currently used to supply liquid hydrocarbon volatile fuels to a wide range of two-cycle and four-cycle internal combustion engines including hand held engines such as engines for chainsaws and weed trimmers as well as a wide range of marine engine applications. Diaphragm type carburetors are particularly useful for hand held and other engine applications wherein the engine may be operated in substantially any orientation including up side down. Typically, diaphragm carburetors have been used with two-cycle engines and there is a continuing struggle to reduce the exhaust emissions of these engines to prevent escape to the atmosphere of hazardous hydrocarbon vapors and to comply with increasingly strict governmental regulations regarding the same. Still further, engine manufacturers are continually seeking carburetors which are easy to calibrate and of low cost to manufacture and assemble.

A typical diaphragm type carburetor has a diaphragm fuel pump which draws liquid fuel from a fuel tank and delivers that fuel under pressure to a fuel metering system which provides a metered quantity of fuel into a stream of air flowing through the carburetor for delivery to the engine. Undesirably, a significant amount of fuel vapor may exist within the fuel system, such as within the fuel tank and/or fuel lines leading to the carburetor. Fuel may also tend to vaporize within the carburetor to provide still further fuel vapor within the fuel system. This fuel vapor tends to collect in various portions of cavities and passages within the carburetor to form large vapor bubbles and large clusters of vapor bubbles. When the large vapor bubbles, clusters or portions thereof are drawn along with the liquid fuel supply and delivered to the engine, the fuel supply to the engine can become inconsistent or undesirably lean resulting in unstable engine operation, especially for engines equipped with fuel injection apparatus. To combat this, the carburetor may be set to provide a somewhat richer than required fuel and air mixture to ensure adequate fuel is supplied to the engine. However, this may increase the hydrocarbon content of the engine emissions. These problems are exasperated with engine operation at ambient temperatures above 80° F. which causes the rate of fuel vapor generation to increase significantly.

SUMMARY OF THE INVENTION

A carburetor having a plurality of restricted fluid flow paths upstream of a fuel and air mixing passage to inhibit the passage of large fuel vapor bubbles through the fuel paths and to the fuel and air mixing passage. Desirably, the restricted flow paths constrain large volume vapor bubbles and clusters from passing therethrough undistributed to prevent an inconsistent or overly lean fuel and air mixture from being delivered to the engine. At least two restrictive flow paths diffuse, separate, disperse and/or break up the large vapor bubbles and clusters into a plurality of smaller vapor bubbles which are more uniformly separated and distributed within the liquid fuel flowing through the carburetor to provide a more consistent flow of fuel to the engine.

In one form, the restrictive flow paths comprise a plurality of small openings in the carburetor body which define an outlet of a fuel metering chamber from which the fuel is supplied to the fuel and air mixing passage. In another form, the restrictive flow paths are defined through a porous material disposed between a fuel pump and the fuel metering chamber of the carburetor downstream of the fuel pump. Both the porous material between the fuel pump and fuel metering chamber and the plurality of holes defining the outlet of the fuel metering chamber may be used in the same carburetor, if desired.

Objects, features and advantages of this invention include providing a carburetor which provides a more stable supply of fuel to an engine, reduces the hydrocarbon exhaust emissions from the engine, facilitates calibrating the carburetor for a particular engine or engine family, prevents large volumes of undispersed fuel vapor from being delivered to the engine all at once, improves engine operation especially at ambient temperatures above 80° F., provides a pressure restriction between the fuel pump and fuel metering chamber to improve pressure regulation and fuel flow through the carburetor, is of relatively simple design and economical manufacture and assembly, reliable, durable, and in service has a long useful life.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
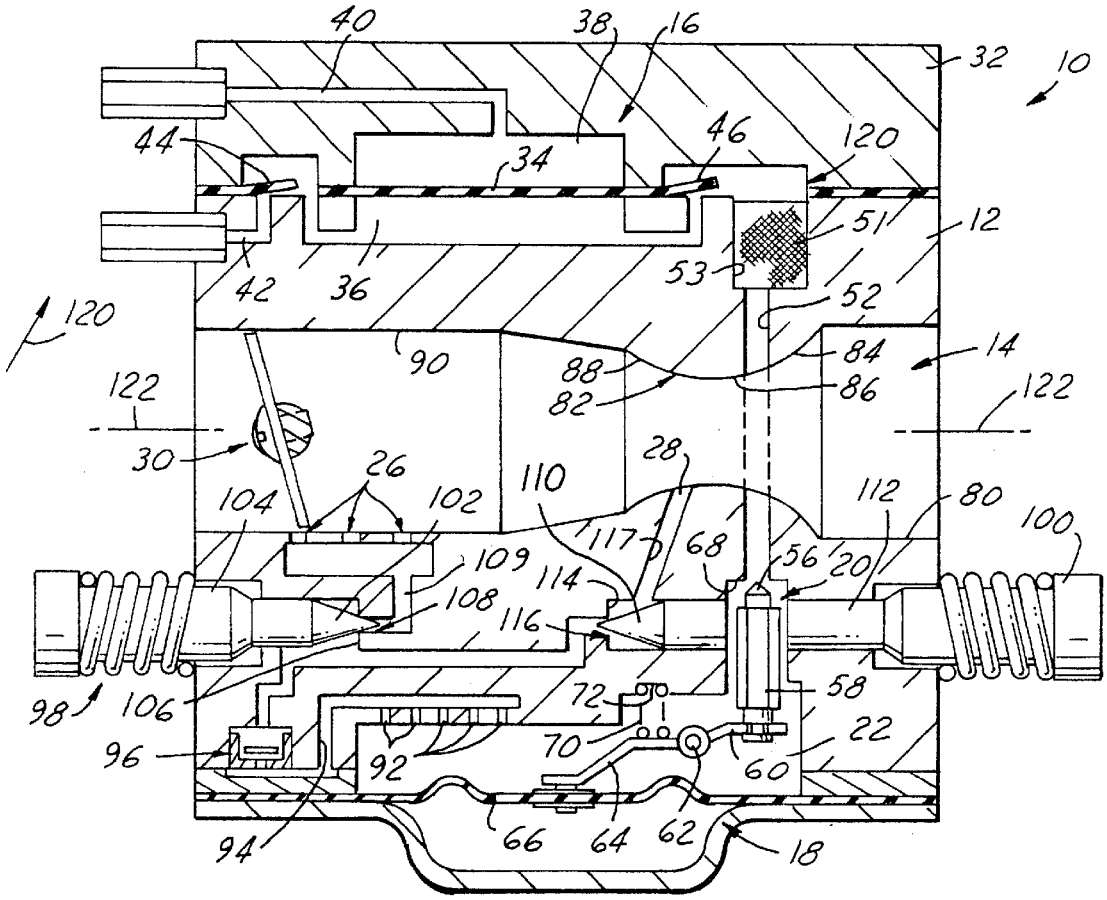
FIG. 1 is a sectional view of a carburetor embodying the present invention.
Figure 2:
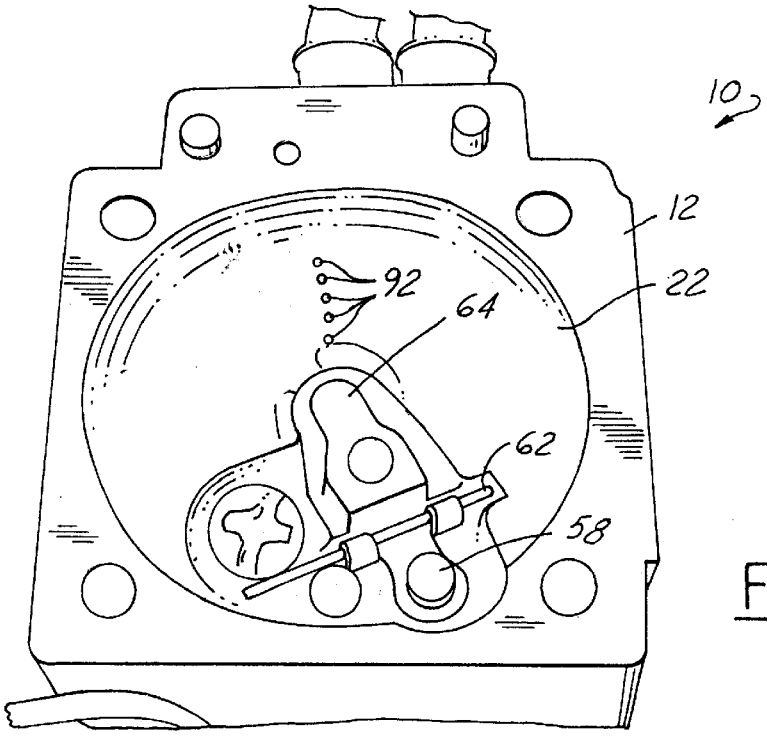
FIG. 2 is a perspective view of the body of the carburetor of FIG. 1 with an end cap and fuel metering diaphragm removed.

Referring in more detail to the drawings, FIGS. 1 and 2 illustrate a diaphragm type carburetor 10 embodying the present invention and having a main body 12 with a fuel and air mixing passage 14 therethrough, a fuel pump 16, and a fuel metering assembly 18 communicating with the outlet of the fuel pump 16 through a diaphragm controlled valve 20. The fuel pump 16 draws fuel from a fuel source such as a fuel tank and delivers it to a fuel metering chamber 22 which communicates with the fuel and air mixing passage 14 through one or more adjustable needle valves, low speed fuel nozzles 26 and a high speed fuel nozzle 28 downstream of the needle valves. A throttle valve 30 in the fuel and air mixing passage 14 controls the flow of air therethrough and thus varies the magnitude of the pressure drop across the low speed fuel nozzles 26 and the high speed fuel nozzle 28 to control the flow of fuel through the nozzles 26, 28 and the delivery of a fuel and air mixture to the engine.

As shown in FIG. 1, the fuel pump 16 is defined between an end plate 32 and the carburetor body 12 and has a diaphragm 34 defining a fuel chamber 36 on one side and a crankcase pressure pulse chamber 38 on its other side communicating with the engine crankcase through a passage 40. Negative pressure pulses from the engine crankcase displace the diaphragm 34 in a direction tending to increase the volume of the fuel chamber 36 to draw fuel from a fuel tank through an inlet passage 42 in the body 12. A fuel inlet valve 44 which is preferably a flap type check valve integral with the fuel pump diaphragm 34 is opened by the decreased pressure within the fuel chamber 36 to permit fuel flow therethrough and into the fuel chamber 36. A subsequently provided positive pressure pulse from the engine crankcase to the pressure pulse chamber 38 displaces the fuel pump diaphragm 34 in a direction tending to decrease the volume of the fuel chamber 36 to thereby increase the pressure of the fuel therein and to discharge it through an outlet valve 46. The outlet valve 46 is also preferably flap type check valve integral with the fuel pump diaphragm 34 and is opened by the increase in pressure in the fuel chamber 36.

Fuel discharged from the fuel pump outlet is delivered under pressure to the fuel metering assembly 18 of the carburetor 10 through a porous member 51 received in a counterbore 53 in the body 12 and a fuel metering inlet passage 52. The porous member 51 preferably serves as a fuel filter to remove contaminants from the fuel. In accordance with this invention, the porous member 51 provides a diffuser which breaks up large vapor bubbles and large clusters of bubbles into separate smaller vapor bubbles and may absorb or restrict the flow of these smaller vapor bubbles through the member 51. The smaller vapor bubbles are more evenly dispersed or distributed in the liquid fuel flowing through the member 51 as compared to the large vapor bubbles and clusters to provide a more uniform and consistent supply of liquid fuel to the fuel metering assembly 18. The porous member 51 is preferably relatively thick axially or in the direction of fuel flow to inhibit the recombination or coalescence of fuel vapor into large bubbles or clusters downstream of the member 51 such as occurs with a relatively thin filter or screen at the outlet of the fuel pump 16. The member 51 may be a felt material, open or closed cell foam, sintered bronze, a synthetic compound, or other permeable substance or material which defines, in essence, a plurality of flow paths and permits a sufficient flow rate of fuel therethrough while preventing the passing of large vapor bubbles and large clusters of bubbles. The porous member 51 preferably has an average pore size of about 20 $\mu$m to 500 $\mu$m, a height or axial length of about 1 mm to 12 mm, a diameter of about 1.5 mm to 6 mm and a nominal size or volume of about 0.0018 cc to 0.340 cc.

The fuel metering assembly 18 functions as a vacuum actuated pressure regulator receiving pressurized fuel from the fuel pump 16 and regulating its pressure to a predetermined pressure, usually subatmospheric, to control the delivery of fuel from the fuel metering assembly 18. The assembly 18 has an inlet valve 20 with a needle shaped head 56 and a shank 58 which is actuated by a lever arm 60 connected at one end to the valve, fulcrumed between its ends on a pin 62 and having a control arm 64 actuated at its free end by a fuel metering diaphragm 66. The inlet valve 20 is yieldably biased to its closed position bearing on a valve seat 68 by a coil spring 70 received in a pocket 72 of the carburetor body 12 and bearing on the arm 64 of the lever arm 60. As the pressure changes within the fuel metering chamber 22 defined on one side of the fuel metering diaphragm, the fuel metering diaphragm is displaced to bear on the arm 64 and hence rotate the lever arm 60 to cause a corresponding movement of the inlet valve 20 between its open and closed positions to selectively permit fuel to enter the metering chamber 22 through the inlet valve 20.

In use, as fuel is drawn from the metering chamber 22, the quantity of fuel therein will decrease and the differential pressure on the metering diaphragm 66 will move the lever arm 60 against the bias of the spring 70 in a clockwise direction (as viewed in FIG. 1), to open the valve 20 and allow fuel to enter the metering chamber 22. As the metering chamber 22 fills with additional fuel, the diaphragm 66 will tend to move the lever arm 60 clockwise and close the valve 20 to thereby regulate the pressure of the fuel within the metering chamber 22.

Desirably, the porous member 51 also acts as a buffer between the fuel pump outlet and the inlet valve 20 and attenuates fluctuations in and reduces the magnitude of pulses in the fuel pressure produced by the fuel pump. The porous member 51 also increases the resistance to fuel flow which causes the valve 20 to be opened further to obtain the required fuel flow through the valve 20 which provides a smoother or improved pressure regulation of fuel supplied to the nozzles 26, 28 and lower velocity fuel flow across the valve 20 to reduce the generation of fuel vapor and improve carburetor performance.

The carburetor body 12 has a fuel and air mixing passage 14 formed therethrough with the throttle valve 30 disposed in a downstream portion of the fuel and air mixing passage 14. An upstream or choke valve bore portion 80 of the fuel and air mixing passage 14 preferably contains or cooperates with a choke valve (not shown) and leads to a venturi 82. The venturi 82 has a converging upstream portion 84, a throat 86 and a diverging downstream portion 88 leading to a throttle valve portion 90 of the passage 14 containing the throttle valve 30.

In accordance with this invention, fuel in the metering chamber 22 is supplied preferably to both the high speed fuel nozzle 28 and idle or low speed fuel nozzles 26 through at least two holes 92 which collectively define a fuel outlet of the metering chamber 22. The holes 92 each extend essentially perpendicular to and open into a fuel feed passage 94 which leads to a check valve 96 and both a low speed needle valve 98 and a high speed needle valve 100, which adjust fuel flow to the low speed fuel nozzles 26 and the high speed fuel nozzle 28, respectively. The check valve 96 prevents the back bleeding of air from the fuel and air mixing passage 14 to the fuel metering chamber 22 during purging of the carburetor or otherwise when the metering chamber 22 is at a vacuum or negative pressure (relative to the air mixing passage 14).

The low speed needle valve 98 has a valve head or conical tip 102 on a shank 104 threaded into the body 12 and axially displaceable relative to a valve seat 106 to control the size of the annular gap or orifice 108 between them and leading to a fuel passage 109 to provide a restriction under at least some fuel flow conditions and thereby control the flow of fuel from the fuel metering chamber 22 to the low speed fuel nozzles 26. Similarly, the high speed needle valve 100 has a valve head or conical tip 110 on a shank 112 threaded into the body 12 and axially displaceable relative to a valve seat 114 to control the size of the annular gap or orifice 116 between them and leading to a fuel passage 117 to provide a restriction under at least some fuel flow conditions and thereby control the flow of fuel from the fuel metering chamber 22 to the high speed fuel nozzle 28.

The holes 92 define the metering chamber outlet and a plurality of essentially separate fuel flow paths and are sized to inhibit and preferably prevent the passage of large vapor bubbles and clusters therethrough. In contrast, conventional carburetors have a fuel metering chamber outlet defined by a single opening generally of the same diameter as a passage immediately downstream thereof which permits large vapor bubbles and clusters to flow therethrough thereby reducing the volume of liquid fuel supplied to the engine at a given time, by including the large vapor bubbles and clusters, providing a leaner, and thereby inconsistent fuel supply to the engine. As any large vapor bubbles or clusters are drawn into the holes 92, they are broken up into a plurality of separate, smaller vapor bubbles and are dispersed within the liquid fuel flowing through the holes 92 to provide a more uniform distribution of fuel vapor within the liquid fuel which exits the metering chamber 22. Desirably, the flow of fuel and/or fuel vapor through each hole 92 causes the flow velocity to increase resulting in turbulent flow which aids in the breakdown into small fuel vapor bubbles and the emulsion and dispersion of the smaller fuel vapor bubbles within the liquid fuel and inhibits or prevents the smaller bubbles from coalescing into large bubbles or clusters downstream of the holes 92. Desirably, this provides a more consistent and stable supply of liquid fuel to the fuel and air mixing passage and hence, a more consistent and stable fuel and air mixture delivered to the engine. Therefore, the temporary supply of an undesirably lean fuel and air mixture to the engine due to the presence of large vapor bubbles and clusters in the liquid fuel is avoided. As a result, the carburetor does not have to be calibrated to provide a richer than required fuel and air mixture to the engine and the hydrocarbon emissions of the engine are reduced.

Preferably, the holes 92 are formed in a location where fuel vapor normally collects within the metering chamber 22 to assist in the scavenging of fuel vapor and to prevent the collection of an excessive amount of fuel vapor within the carburetor which might affect pressure regulation and consistent fuel delivery. Desirably, the holes 92 are formed in or near the highest location of the metering chamber relative to the standard or normal operating position (indicated by arrow 120 in FIG. 1) of the carburetor 10 in use, as fuel vapor will tend to rise to this location. For clarity, the standard or normal operating position 120 of the carburetor is rotated slightly clockwise relative to its orientation as drawn in FIG. 1 until the axis 122 of the mixing passage 14 is perpendicular to a line containing arrow 120. The holes 92 may be of generally any size depending on the number of holes as long as they are small enough to effectively break-up, separate, diffuse and/or disperse the large bubbles and clusters into suitably smaller bubbles. This will be dependent on the carburetor size and design and the type and size of the engine. If the holes 92 are positioned in a desired area of the metering chamber 22 where vapor bubbles tend to gather and collect, the holes 92 may be larger in size as the bubbles will be drawn through on a more consistent basis and before excessively large bubbles or clusters are permitted to form in the metering chamber 22. If the holes 92 cannot be formed in an ideal location such that the fuel vapor is not consistently drawn out of the metering chamber 22 and undesirably large vapor bubbles and clusters may form in the metering chamber 22, then the holes 92 should be made smaller to ensure the large bubbles and clusters are adequately broken-up and dispersed. In any event, the holes 92 must have a combined area large enough to avoid causing an undue restriction to fuel flow from the metering chamber 22 and to permit a sufficient fuel flow therethrough so that the carburetor can supply enough fuel to meet the maximum fuel demand of the engine.

Desirably, the combined flow area of all of the holes 92 is equal to or greater than the flow area of the fuel feed passage 94 downstream thereof. Preferably, the holes 92 have a combined flow area at least as large and preferably greater than the flow area of either needle valve 98, 100 so that the needle valves 98, 100 provide a restriction which may be adjusted to control fuel flow to the nozzles 26, 28. If the holes 92 are very small the drag or resistance to flow therethrough may increase requiring additional holes to provide a sufficient fuel flow from the metering chamber 22. Additionally, with very small holes 92 on the order of about 0.13 mm to 0.20 mm in diameter, clogging of the holes can be a problem requiring very fine filtering upstream of the holes 92. For carburetors for most small displacement engines, generally less than 50 cc's, the holes 92 are each preferably less than 1.0 mm in diameter. Further, the holes 92 preferably have a short length so that fuel vapor which flows into a hole is quickly combined with fuel flowing through the other holes and within the fuel feed passage. The length of each hole is preferably between about 0.25 mm to 0.76 mm.

In one embodiment, for a carburetor with a fuel feed passage 94 having a diameter of 1 mm, an effective implementation of the present invention comprised providing four holes 92 in the body 12 with each hole 92 about 0.56 mm in diameter to provide a combined flow area of the holes 92 slightly larger than the flow area of the fuel feed passage 94. In a conventional carburetor, the metering chamber outlet would simply be defined by a single opening defined by the drilling forming the fuel feed passage and of the same diameter as this passage. Although in this example the combined flow area of the holes 92 is greater than the flow area of the fuel feed passage 94, as previously mentioned, this does not have to be true. The combined flow areas of the holes 92 may be less than or equal to the flow area of the fuel feed passage 94 but is preferably always greater than the effective flow area through each needle valve 98, 100.

Figure 3:
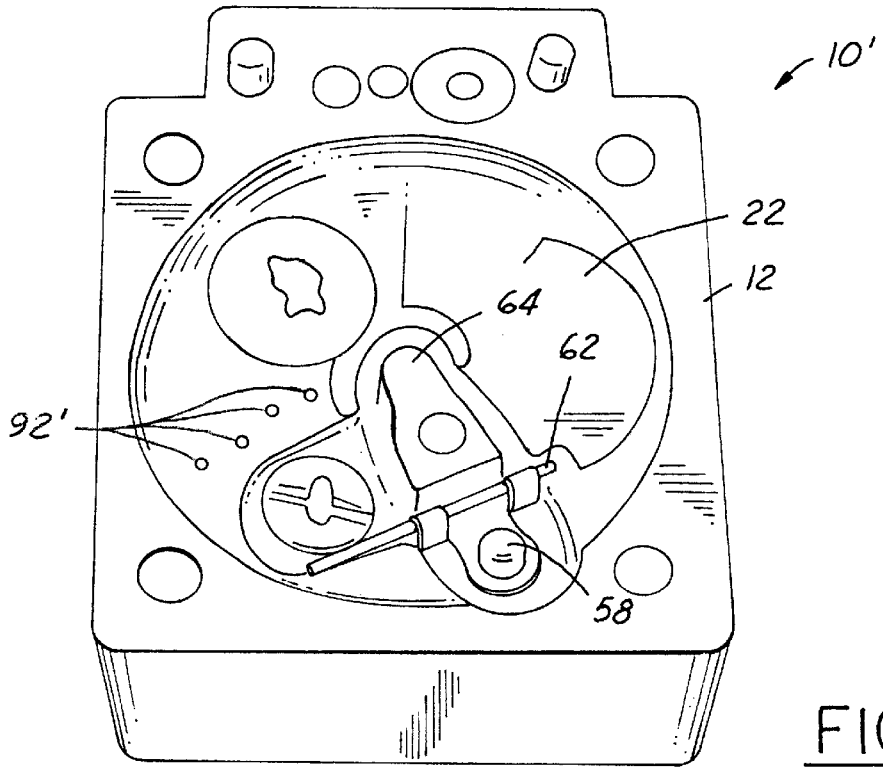
FIG. 3 is a perspective view of a body of another carburetor embodying the present invention.
Figure 4:
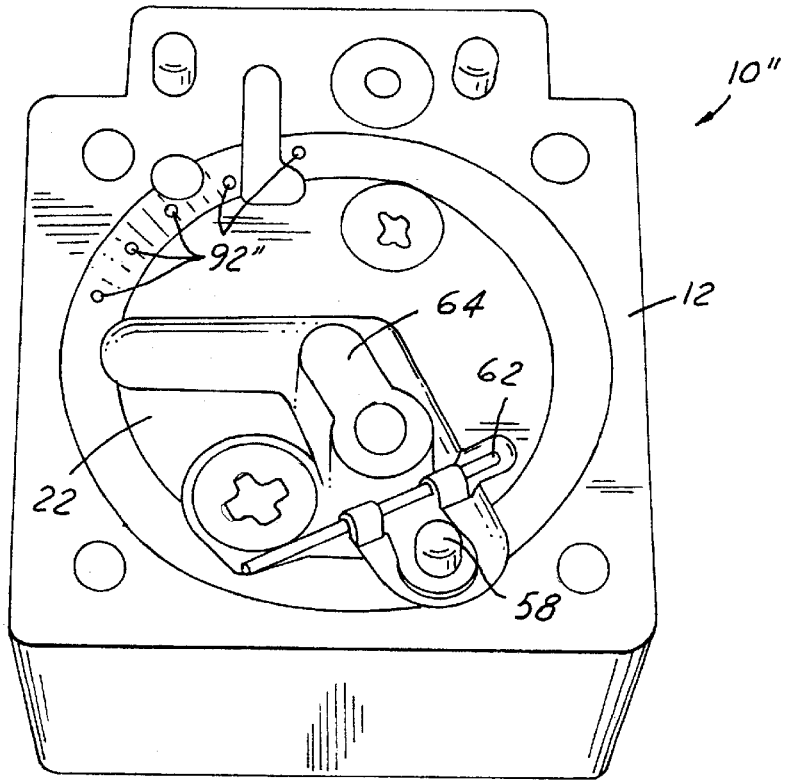
FIG. 4 is a perspective view of a body of another carburetor embodying the present invention.

FIGS. 3 and 4, illustrate alternate embodiments of carburetors 10' and 10", with bodies having holes 92' and 92", respectively, formed in different locations relative to the metering chamber 22. In each embodiment 10',10" the holes 92',92" define the outlet of the metering chamber 22 as in the first embodiment carburetor 10. In FIG. 4, the holes are formed about a portion of the perimeter of the fuel metering chamber 22 and lead to a pair of branch passages which communicate with each other to direct all of the fuel and/or vapor to the downstream needle valves and associated fuel nozzles 26, 28. The holes 92, 92', 92" may be moved as desired and are preferably disposed in the uppermost or highest location in the fuel metering chamber relative to the standard or usual operating position of the carburetor when assembled on a particular engine, because this is where the fuel vapor is likely to collect. Thus, this position helps to more consistently remove the fuel vapor from the metering chamber as it collects to prevent excessively large bubbles or large clusters of bubbles from gathering in the fuel metering chamber.

Each of the carburetors 10, 10', 10" has a fuel supply circuit 120 defined at least in part in the main body 12 and comprising the fuel pump 16, the fuel metering inlet passage 52, the fuel metering chamber 22, the fuel feed passage 94, and the fuel passages 109, 117 and nozzles 26, 28 leading to the fuel and air mixing passage 14. Desirably, the porous member 51 and the holes 92, 92', 92" are also provided in the fuel supply circuit 120 and each provide a plurality of essentially separate fuel flow paths through which the fuel flows to break up large fuel vapor bubbles and clusters and provide a more consistent and stable supply of fuel to the engine. The combined flow of the fuel flow paths is sufficient to meet the maximum engine fuel demand and preferably, no single fuel flow path is sufficient to meet the maximum engine fuel demand. If desired, only one of the porous member 51 or the holes 92, 92', 92" may be provided in a carburetor.

While the holes 92, 92', 92" have been described with reference to defining an outlet of the fuel metering chamber 22, the invention can be applied elsewhere in the carburetor to limit the passage of large vapor bubbles and clusters through the carburetor. For example, a plurality of small holes could be formed downstream of the fuel pump outlet and leading to the fuel metering inlet passage 52. Similarly, the porous member 51 can be disposed in areas or passages of the carburetor other than the counterbore 53 downstream of the fuel pump 16. Still other modifications within the spirit and scope of the appended claims will be apparent to those skilled in the art.

What is claimed is:

1. A carburetor for an engine, comprising:

a body having a fuel and air mixing passage therethrough at least one nozzle opening into the air mixing passage and configured to discharge fuel into the air mixing passage, a metering chamber defined at least in part in the body, having an inlet in communication with a supply of fuel, and an outlet defined by a plurality of separate holes in the body upstream of all of the nozzles and through the nozzles in communication with the fuel and air mixing passage and positioned within the body at a location to which fuel vapor normally collects at least when the body is in its normal operating position so that fuel vapor and liquid fuel in the metering chamber are drawn from the metering chamber through at least one of said plurality of holes for delivery through at least one nozzle to the fuel and air mixing passage, and the plurality of holes have a combined flow area sufficient to enable the carburetor to satisfy the maximum fuel demand of the engine and no single one of the plurality of holes has an area sufficient to enable the carburetor to satisfy the maximum fuel demand of the engine and each hole has an area small enough to inhibit the passage of large vapor bubbles and clusters of bubbles downstream thereof and to break them into smaller bubbles which pass through the hole and are discharged with liquid fuel through at least one of the nozzles into the fuel and air mixing passage of the carburetor.

2. The carburetor of claim 1 which also comprises a porous member carried by the body, having a plurality of pores through which fuel flows to reduce the size of large vapor bubbles and clusters of bubbles.

3. The carburetor of claim 2 wherein the porous member has an average pore size of between 20 $\mu$m and 500 $\mu$m.

4. The carburetor of claim 2 wherein the porous member has an axial length between 1 mm and 12 mm.

5. The carburetor of claim 2 wherein the porous member has a volume of between 0.0018 cc to 0.340 cc.

6. The carburetor of claim 2 wherein the porous member has an average pore size of between 20$\mu$ and 500 $\mu$m.

7. The carburetor of claim 6 wherein the porous member has an axial length between 1 mm and 12 mm.

8. The carburetor of claim 6 wherein the porous member has a volume of between 0.0018 cc to 0.340 cc.

9. The carburetor of claim 1 which also comprises a diaphragm fuel pump carried by the body and having an inlet in communication with a source of fuel and an outlet through which fuel is discharged under pressure, a fuel passage downstream of and in communication with the outlet and a porous member disposed within the fuel passage and defining a plurality of fuel flow paths through which fuel discharged from the fuel pump flows.

10. The carburetor of claim 9 wherein the porous member has an average pore size of between 20 $\mu$m and 500 $\mu$m.

11. The carburetor of claim 1 wherein each hole of said plurality of holes has a diameter of between about 0.13 mm and 1.0 mm.

12. The carburetor of claim 1 which also comprises a restriction downstream of the plurality of holes constructed to control in part fuel flow to the fuel and air mixing passage and wherein the combined flow area of the fuel flow paths is at least equal to the flow area of the restriction.

13. The carburetor of claim 12 which also comprises a needle valve carried by the body and defining the restriction.

14. The carburetor of claim 12 wherein the combined flow area of the plurality of holes is greater than the flow area of the restriction.

15. The carburetor of claim 12 wherein the restriction is disposed between the outlet of the metering chamber and the fuel and air mixing passage.

16. The carburetor of claim 1 wherein the plurality of holes are positioned in the area of the highest portion of the fuel metering chamber relative to the normal operating position of the carburetor.

17. The carburetor of claim 1 which also comprises a fuel feed passage communicating the metering chamber outlet with the fuel and air mixing passage and having a flow area greater than any one of said plurality of holes.

18. The carburetor of claim 17 wherein the combined flow area of the plurality of holes is at least equal to the flow area of the fuel feed passage.

19. The carburetor of claim 17 wherein each of the plurality of holes extends essentially perpendicularly to the fuel feed passage.

20. The carburetor claim 1 wherein each hole has a length between 0.25 mm and 0.76 mm.

* * * * *